US005310118A

United States Patent [19]

Reymonet

[11] Patent Number: 5,310,118

[45] Date of Patent: May 10, 1994

[54] MECHANICAL ACTUATING DEVICE FOR OPENING OR CLOSING A VALVE CONTROLLING A NOZZLE MOVABLE ALONG A PRESENT TRAJECTORY

[75] Inventor: Jean-Pierre Reymonet, Le Chesnay, France

[73] Assignee: Colas S.A., Boulogne Billancourt Cedex, France

[21] Appl. No.: 925,849

[22] Filed: Aug. 7, 1992

[30] Foreign Application Priority Data

Aug. 9, 1991 [FR] France ..... 91 10193

[51] Int. Cl.[5] ..... B05B 1/14

[52] U.S. Cl. ..... 239/551; 251/251

[58] Field of Search ..... 239/551, 168, 170, 167; 251/325, 251, 289

[56] References Cited

U.S. PATENT DOCUMENTS

| | | | |
|---|---|---|---|
| 2,153,356 | 4/1939 | Walker | 239/551 |
| 2,197,231 | 4/1940 | Walker | 239/551 |
| 2,472,199 | 6/1949 | Entyre | 239/551 |
| 2,629,629 | 2/1953 | Etnyre | 239/551 |
| 2,657,092 | 10/1953 | Jones | 239/551 |
| 4,923,167 | 5/1990 | Schmidt | 251/325 X |
| 4,960,242 | 10/1990 | Larson | 239/551 X |

FOREIGN PATENT DOCUMENTS 2323852 11/1974 Fed. Rep. of Germany .

*Primary Examiner*—Andres Kashnikow
*Assistant Examiner*—Lesley D. Morris
*Attorney, Agent, or Firm*—Sandler Greenblum & Bernstein

[57] ABSTRACT

Mechanical actuating device for opening or closing a valve of at least one nozzle, the nozzle moving along a path preset with respect to a support. The valve comprises a mobile control unit which is movable between an open position and a closed position, and elements for mechanically moving the control unit including at least one guide rail fitted with a flexure in the area of the open or closed position enabling the control unit to switch from one position to the other.

22 Claims, 2 Drawing Sheets

MECHANICAL ACTUATING DEVICE FOR OPENING OR CLOSING A VALVE CONTROLLING A NOZZLE MOVABLE ALONG A PRESENT TRAJECTORY

BACKGROUND OF THE INVENTION

1. Field of the Invention

The present invention relates to a mechanical actuating device for opening or closing a valve that controlling a nozzle movable along a present trajectory with respect to a support.

2. Discussion of Background Information

More especially, this actuating device finds application on carriage construction machinery, such as finishers, for instance of the same type as those described in commonly assigned application for French patent FR-90.06306 dated May 21, 1990, entitled "Spreading device for a fluid material or analogical, especially a bonding emulsion for bituminous coated materials, over a road surface and carriage way construction machinery, especially finishers, comprising such a device", which was published as FR-A-2,662,193 on Oct. 30, 1992, and is a family member of U.S. patent application Ser. No. 07/685,952, filed Apr. 17, 1991. The finishers described in this application are fitted with a spreading assembly enabling the spreading of bonding emulsion for bituminous coated materials, together with applying the coated materials over the road surface. This spreading assembly comprises mainly, on a mobile finishing vehicle, at least one spreading rail fitted with nozzles, and in order to perform the spreading operation of the whole width of the road, a mechanism for moving the spreading rail from one side to the other, transversely with respect to the displacement direction of the mobile finishing vehicle.

It has appeared necessary, especially for adjusting the spreading width, to add a device to control the opening or the closing of the nozzles when they pass through a given point on their transverse path with respect to the chassis of the mobile finishing vehicle. This point may be a limit of the spreading width, for instance.

A classic remedy for this problem would have consisted of using servovalves. But the spreading assembly would have been far more expensive and far more complex.

By the present invention there is provided an actuating device, for opening or closing a valve controlling a nozzle, which is exclusively mechanical.

SUMMARY OF THE INVENTION

The object of the invention is to provide a mechanical actuating device for opening or closing a valve of at least one nozzle following a movement according to a preset route with respect to a support. The valve comprises a mobile control unit movable between two positions, an open one and a closed one, with the mechanical actuating device comprising intermediate operation means for mechanically energizing the mobile control unit to switch it from one position to the other.

Preferably, the valve should be a stop slide valve, and the control unit is mounted in order to slide, with respect to the nozzle, and be moved back and forth between these two open and closed position. Moreover the energizing means comprise at least one guide rail, in the opening or closing area, exhibiting a flexure enabling the switching of the control unit from one position to the other.

According to a preferred embodiment, the device comprises two guide rails, facing each other, on which the control unit or the intermediate operation means are designed to contact in order to, according to the displacement direction of the nozzle, switch the control unit from one of its positions to the other.

Advantageously, this device comprises at least one roller which is mounted on the control unit or the intermediate operation means at the position where the mobile control unit or the intermediate operation means makes contact with one of the guide rails.

Preferably, the intermediate operation means comprise two levers, each lever bearing upon opposite ends of the mobile control unit, respectively, and swivel-tied on axles fixed with respect to the nozzle. In this regard, the levers will be actuated by the guide rail so as to swivel whenever the nozzle passes through the opening or closing area of the valve and thus moving the control unit, by pressing against it, from one of its open or closed positions to the other.

Advantageously, the levers are joined to each other by a rod used for co-ordinating their swivelling action.

According to the invention, this embodiment comprises a guiding assembly, inside which the nozzle and the mechanical actuating device slide within an opening or closing area of the valve of the nozzle. The guiding assembly comprises a guiding groove, inside which a projection of the nozzle slides and guide rails against which are contacted by the levers.

Preferably, the mobile control unit is a cylindrical distributor sliding inside the nozzle body, wherein the distributor is fitted with an opening for letting fluid through and includes element for preventing the said opening from turning when the distributor is moved.

In a further embodiment, the control unit is a flat plunger forming an inner capsule slide valve.

The object of the invention is also to provide a spreading assembly which comprises, on a mobile vehicle, a spreading rail fitted with nozzles and performing a back and forth motion with respect to the displacement direction of the vehicle. Moreover, at least one nozzle on the rail is linked to an actuating device for energizing its valve.

According to a preferred embodiment, the width area of the vehicle, where the device controls the opening or the closing of the valve, is adjustable.

DESCRIPTION OF THE PREFERRED EMBODIMENTS

Figure 1:
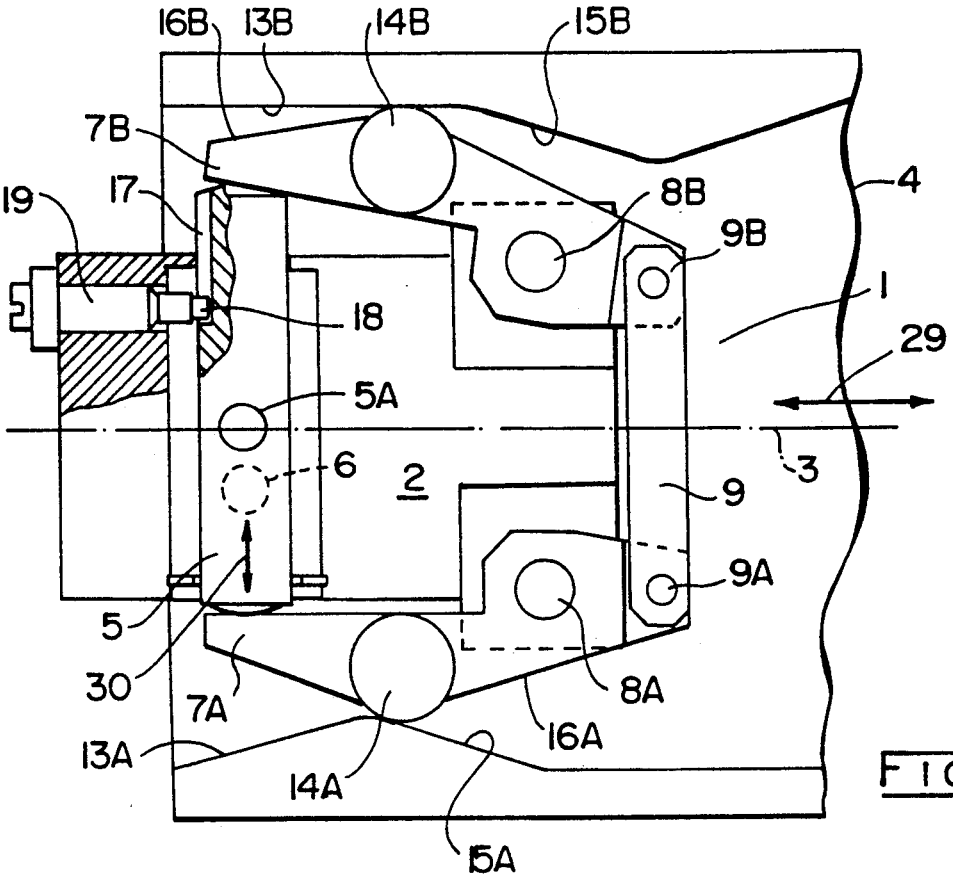
FIG. 1 is a diagram from underneath showing a mechanical actuating device complying with a first embodiment of the invention.
Figure 2:
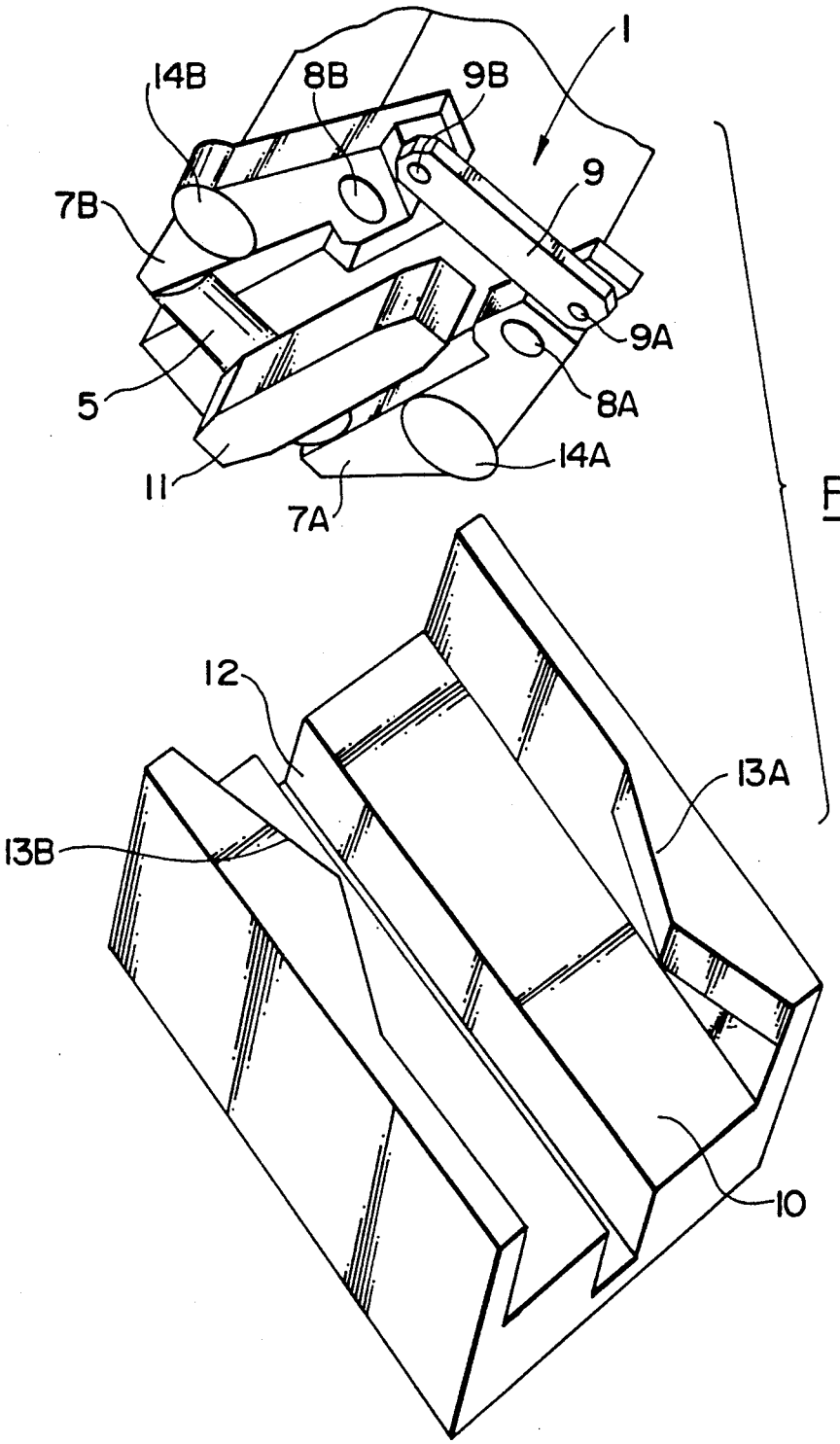
FIG. 2 is a perspective view of the device of FIG. 1 and of a guiding device, inside which the mechanical actuating device slides.

The mechanical actuating device represented more specifically in FIGS. 1 and 2 is generally referred to as (1). Its purpose is to open and close the valve of one of the nozzles (2) of a spreading rail (3) mounted on a mobile vehicle (4) (in order not to overcrowd the FIGURES, the rail (3) has been represented with a mixed line only). A variety of such nozzles (2) are located at regular intervals along the length of the spreading rail (3). This rail (3) moves on the mobile vehicle (4), transversely with respect to the displacement direction of the vehicle.

This spreading rail (3) is, for instance, designed for spreading bituminous bonding materials over a road surface. Its structure is similar to that described in the to above-discussed FR-90.06306, which is a family member of U.S. patent application Ser. No. 07/685,952.

The valve of nozzle (2) is a stop slide valve. It comprises a distributing element (5) with a distribution hole (5*a*), whereas this element can move with respect to a discharge hole (6) of the nozzle (2) between two positions: one for blocking the passage of fluid towards the discharge hole (6), the other for letting fluid through.

Sliding of the distributing element (5) from one position to the other is controlled by two levers (7A) and (7B) whose ends bear upon opposite ends of the distributing element (5). Each lever (7A) and (7B) is swivel-jointed on an axle (8A, 8B) respectively on one side of the nozzle (2) body. At the ends of each lever 7A and 7B farthest from the distributing element (5), the levers are jointed to opposite ends of a rod (9). This connection is designed for coordinating the swivel motions of the levers. The articulation axles of the levers (7A) and (7B) on the coordinating rod (9) are illustrated in FIGS. 1 and 2 as (9A) and (9B). They are parallel to the axles (8A) and (8B).

A guiding assembly (10) is located along the preset path of the nozzle (2), where the opening or the closing of the valve of the nozzle (2) must be controlled. This assembly (10) is designed for guiding the nozzle (2) over a small displacement track. To this end, the nozzle (2) shows (see FIG. 2) on its center length a projection (11) in the shape of a longitudinal lug, designed for engaging into a groove (12) of the guiding assembly (10). The guiding assembly (10) also comprises two lateral guiding rails (13A) and (13B) against which, when the nozzle (2) is engaged into the guiding assembly (10), the levers (7A) and (7B) will contract, respectively. In the contact area with the rail (13A) or (13B), each lever (7A) and (7B) is fitted with a roller (14A) or (14B). The rails (13A) and (13B) show parallel profiles and a flexure (15A), (15B) corresponding to the motion to be imparted to the distributing element (5) to switch it from its open position to its closed position. The surfaces of the levers (7A) and (7B), designed for facing the rails (13A) and (13B), comprise tilted panels (16A) and (16B), along which the levers flare from their ends to their center section, where the rollers (14A) and (14B) are mounted. The guiding projection (11) also shows, towards each end, such tilted panels. All these tilted panels will facilitate the engaging of the nozzle (2) and its actuating device (1) to the guiding assembly (10).

On one section of its length, at its end in contact with the lever (7B), the distributing element (5) shows a groove (17) into which a screw (19), in the shape of a positioning pin, mounted on the body of the nozzle (2), engages. The purpose of this groove (17) and of the end (18) of the screw is to prevent the distributor (5) from rotating when actuated by the levers (7A) and (7B).

The operation the described mechanical actuating device is as follows. During a spreading cycle, the spreading rail (3) the nozzle describes a motion (illustrated with a double arrow in FIG. 1), crosswise with respect to the vehicle (4) on which it is mounted. As a nozzle (2) moves within the guiding assembly (10), the nozzles must stop or start the spreading, according to the direction of their displacement.

When the nozzle (2) and the actuating device (1) slide into the guiding assembly (10), the levers (7A) and (7B), in contact with the guiding rails (13A) and (13B) with their rollers (14A) and (14B), will swivel around their axles (8A), (8B) when reaching the flexures (15A) and (15B). The coordination of their motion will be ensured by the rod (9). This swivelling motion will switch the distributing element (5) from one of its positions to the other, as illustrated by a double arrow (30) in FIG. 1.

Figure 3:
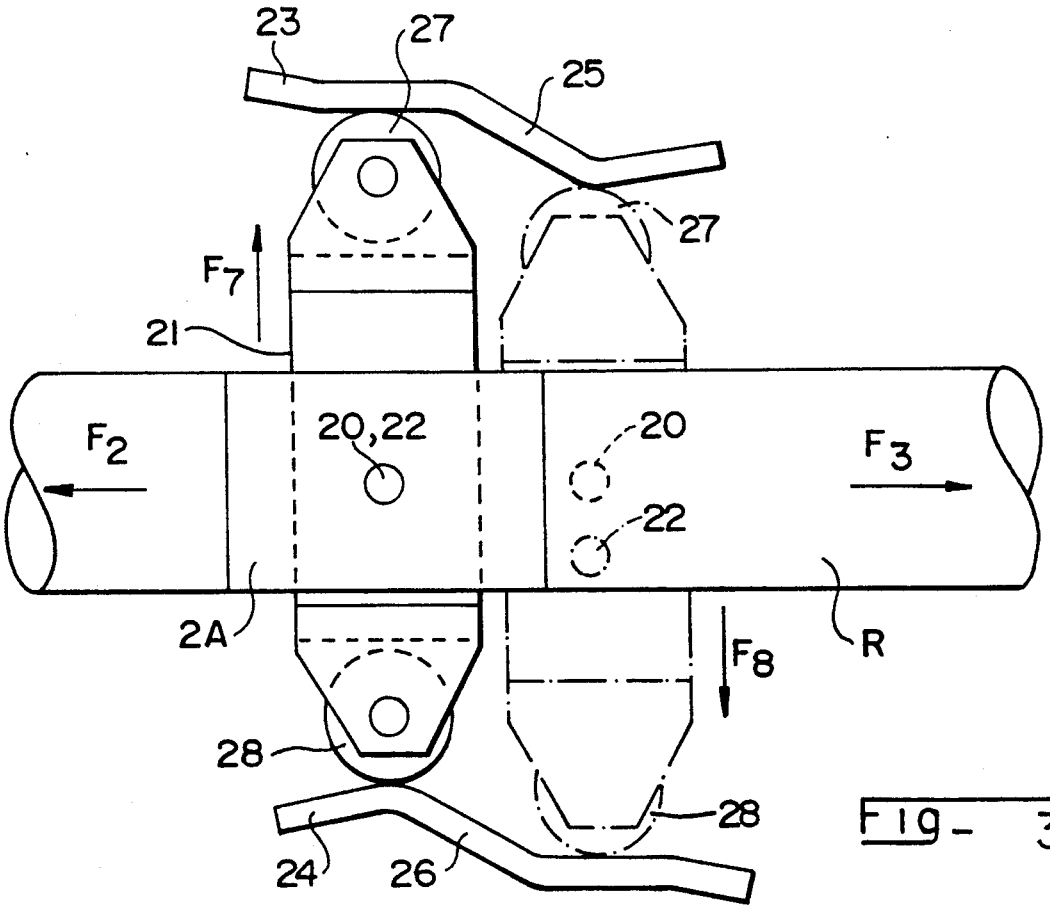
FIG. 3 is a top diagram of a mechanical actuating device complying with another embodiment of the invention.

Another embodiment of the invention is illustrated in FIG. 3. The valve of the nozzle (2A) associated with this device comprises an inner capsule slide element (21) which is a flat plunger that can be moved with respect to the nozzle (2A) linearly between two positions, one to block the fluid to the nozzle (2A) represented with a mixed line in FIG. 3), the other to let the fluid through (represented with a full line in FIG. 3). To this end, the flat plunger (21) is fitted with a hole (22) which coincides with the discharge hole (20) of the nozzle (2A) when the plunger (21) is in position where it lets the fluid flow through.

Rollers (27) and (28) are swivel-mounted on each end of the plunger (21) according to axes perpendicular to the plane of the plunger (21). In addition, the plunger (21) is in contact through rollers (27) and (28) with rails (23) and (24) during at least part of the displacement of the spreading rail R on which the nozzle (2A) is mounted.

Rails (23) and (24) are located on each side of the spreading rail R and of the plungers of the nozzles (2A) to which this rail is linked. The clearance between both these rails (23) and (24) has been selected so that the rollers (27) and (28) slide respectively on both rails (23).

Both these rails (23) and (24) are identical in shape, and they are arranged exactly opposite to each other. Their section corresponding to the position along the preset path of the nozzle (2A) through which the valve (2A) is meant to switch from its open position to its closed position and vice versa, shows a flexure referenced respectively as (25) and (26) against which the rollers, respectively (27) or (28), rolls according to the displacement direction F2 and F3 of the nozzle, to move the plunger (21) towards F7 or F8 respectively.

What is claimed is:

1. A mechanical actuating device for opening and closing at least one nozzle movable along a preset trajectory with respect to a support, comprising:

at least one nozzle movable along a preset trajectory;

a valve associated with each said at least one nozzle; said valve comprising a distributing element movable between an open position wherein a fluid can flow through said valve, and a closed position wherein said valve is sealed; and means for mechanically moving said distributing element between the open position and the closed position comprising at least one guide rail comprising a flexure for enabling said distributing element to move between the open position and the closed position.

2. The mechanical actuating device according to claim 1, wherein said at least one guide rail comprises two guide rails facing each other.

3. The mechanical actuating device according to claim 2, wherein said distributing element contacts said two guide rails to move said distributing element between the open position and the closed position.

4. The mechanical actuating device according to claim 3, comprising at least one roller swivel-mounted on said distributing element, and positioned for contacting said guide rails.

5. The mechanical actuating device according to claim 2, further including intermediate operation means associated with said distributing element for contacting said two guide rails for moving said distributing element between the open position and the closed position.

6. The mechanical actuating device according to claim 5, comprising at least one roller swivel-mounted on said intermediate operation means, and positioned for contacting said guide rails.

7. The mechanical actuating device according to claim 5, wherein said distributing element comprises two ends, and said intermediate operation means comprise two levers, with each of said two levers contacting one of said two ends of said distributing element and being swivel-jointed around a fixed axle.

8. The mechanical actuating device according to claim 7, comprising a rod joining said two levers for coordinating swivelling motion of said two levers.

9. The mechanical actuating device according to claim 1, wherein said means for mechanically moving said distributing element comprise a guiding assembly including said at least one guide rail, and said guiding assembly comprising a guiding groove and said at least one nozzle comprises a projection slidable in said guiding groove.

10. The mechanical actuating device according to claim 1, wherein said at least one nozzle comprises a body, and said distributing element comprises a cylindrical distributor slidable within said body, said distributor including a first aperture forming a passage for fluid.

11. The mechanical actuating device according to claim 10, comprising means for preventing rotation of said first aperture when said distributor slides.

12. The mechanical actuating device according to claim 1, wherein said distributing element comprises a flat plunger forming an inner capsule slide stop.

13. The mechanical actuating device according to claim 12, wherein said plunger comprises a second aperture forming a passage for fluid, and said at least one nozzle comprises a third aperture for passage of fluid, and said plunger is slidable between the open position wherein said second aperture and said third aperture are aligned to permit flow of fluid, and the closed position wherein said first aperture and said second aperture are sealed to prevent flow of fluid.

14. The mechanical actuating device according to claim 13, wherein said plunger comprises two ends, each of said ends comprises a swivel-mounted roller.

15. The mechanical actuating device according to claim 14, wherein said at least one guide rail comprises two guide rails facing each other, and each of said swivel-mounted rollers contacts one of said two guide rails.

16. A mechanical actuating device for opening and closing at least one nozzle movable along a preset trajectory with respect to a support, comprising:

at least one nozzle movable along a preset trajectory;

a valve associated with each of said at least one nozzle; said valve comprising a distributing element movable between an open position wherein a fluid can flow through said valve, and a closed position wherein said valve is sealed; and means for mechanically moving said distributing element between the open position and the closed position comprising two guide rails facing each other, each of said two guide rails comprising a flexure for enabling said distributing element to move between the open position and the closed position; and at least one roller swivel-mounted on said distributing element, and positioned for contacting said guide rails.

17. The mechanical actuating device according to claim 16, wherein said at least one nozzle comprises a body; said distributing element comprises a distributor slidable within said body; said distributor including a first aperture forming a passage for fluid; said at least one nozzle including a second aperture for passage of fluid; and said first aperture and said second aperture being aligned in the open position, and offset in the closed position.

18. A mechanical actuating device for opening and closing at least one nozzle movable along a preset trajectory with respect to a support, comprising:

at least one nozzle movable along a preset trajectory;

a valve associated with each said at least one nozzle; said valve comprising a distributing element movable between an open position wherein a fluid can flow through said valve, and a closed position wherein said valve is sealed; and means for mechanically moving said distributing element between the open position and the closed position comprising two guide rails facing each other, each of said two guide rails comprising a flexure for enabling said distributing element to move between the open position and the closed position; intermediate operation means associated with said distributing element for contacting said two guide rails for moving said distributing element between the open position and the closed position; and at least one roller swivel-mounted on said intermediate operation means, and positioned for contacting said guide rails.

19. The mechanical actuating device according to claim 18, wherein said distributing element comprises two ends, and said intermediate operation means comprise two levers, with each of said two levers contacting one of said two ends of said distributing element and being swivel-jointed around a fixed axle.

20. The mechanical actuating device according to claim 19, comprising a rod joining said two levers for coordinating swivelling motion of said two levers.

21. A spreading assembly, comprising:

a mobile vehicle;

a spreading rail on said mobile vehicle mounted for back and forth movement transverse to a displacement direction of said mobile vehicle; and a mechanical actuation device for opening and closing at least one nozzle movable along a preset trajectory with respect to a support, comprising:

at least one nozzle movable along a preset trajectory;

a valve associated with each said at least one nozzle; said valve comprising a distributing element movable between an open position wherein a fluid can flow through said valve, and a closed position wherein said valve is sealed; and means for mechanically moving said distributing element between the open position and the closed position comprising at least one guide rail comprising a flexure for enabling said distributing element to move between the open position and the closed position.

22. The spreading assembly according to claim 21, wherein said mobile vehicle includes an adjustable width.

* * * * *